US009958129B2

(12) United States Patent
Ruckebusch

(10) Patent No.: US 9,958,129 B2
(45) Date of Patent: May 1, 2018

(54) OPTICAL MODULE FOR VEHICLE HEADLIGHT

(71) Applicant: VALEO VISION, Bobigny (FR)

(72) Inventor: Nicolas Ruckebusch, Courchelettes (FR)

(73) Assignee: VALEO VISION, Bobigny (FR)

( * ) Notice: Subject to any disclaimer, the term of this patent is extended or adjusted under 35 U.S.C. 154(b) by 0 days. days.

(21) Appl. No.: 15/535,213

(22) PCT Filed: Jan. 8, 2016

(86) PCT No.: PCT/EP2016/050288
§ 371 (c)(1),
(2) Date: Jun. 12, 2017

(87) PCT Pub. No.: WO2016/110573
PCT Pub. Date: Jul. 14, 2016

(65) Prior Publication Data

US 2017/0370551 A1 Dec. 28, 2017

(30) Foreign Application Priority Data

Jan. 9, 2015 (FR) ..... 15 50173

(51) Int. Cl.
*H01J 1/02* (2006.01)
*F21S 8/10* (2006.01)
*F21V 29/74* (2015.01)

(52) U.S. Cl.
CPC ..... *F21S 48/325* (2013.01); *F21S 48/1159* (2013.01); *F21S 48/1258* (2013.01); *F21S 48/321* (2013.01); *F21V 29/74* (2015.01)

(58) Field of Classification Search
USPC ..... 313/46, 45
See application file for complete search history.

(56) References Cited

U.S. PATENT DOCUMENTS

| | | | |
|---|---|---|---|
| 2010/0103667 | A1 | 4/2010 | Thrailkill |
| 2010/0103691 | A1 | 4/2010 | Yasuda et al. |
| 2010/0314985 | A1 | 12/2010 | Premysler |
| 2010/0315830 | A1 | 12/2010 | Wan et al. |
| 2011/0267780 | A1 | 11/2011 | Thrailkill |
| 2014/0340870 | A1 | 11/2014 | Premysler |

FOREIGN PATENT DOCUMENTS

| | | |
|---|---|---|
| WO | 2009/091562 A2 | 7/2009 |
| WO | 2009/091562 A3 | 7/2009 |

OTHER PUBLICATIONS

International Search Report dated Feb. 18, 2016 in PCT/EP2016/050288 filed Jan. 8, 2016.
French Search Report dated Oct. 13, 2015 in French Application 1550173 filed Jan. 9, 2015.

*Primary Examiner* — Vip Patel
(74) *Attorney, Agent, or Firm* — Oblon, McClelland, Maier & Neustadt, L.L.P.

(57) ABSTRACT

The invention relates to an optical module comprising a radiator having one or more heat dissipation surfaces, a fan capable of conveying air onto the heat dissipation surface, and a light source supported by the radiator. The principle characteristic of a module according to the invention is the radiator is formed from folded metal sheets, the fan being secured to the radiator by securing means provided in the folded metal sheet.

20 Claims, 2 Drawing Sheets

OPTICAL MODULE FOR VEHICLE HEADLIGHT

Figure 1:
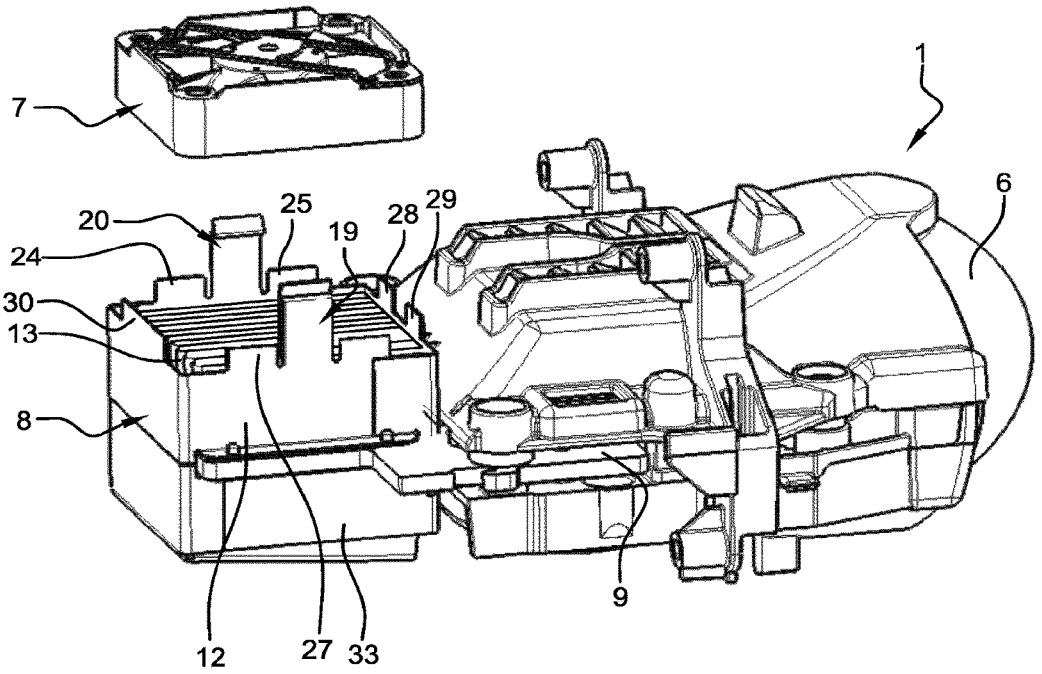

The invention relates to an optical module for a vehicle headlight.

Generally, an optical module of this type functions with a light source, with the disadvantage that heat is emitted. It is thus equipped with a radiator allowing this heat to be absorbed in such a way as to maintain the temperature of said module at a relatively low level. In this way, the functioning of the optical module is not subject to an excessively high temperature.

This type of module has already been the subject matter of patents. Patent application EP2138759, for example, may be cited, which relates to an optical module with the particular feature that it has a light source based on a semiconductor light-emitting device. This module comprises a radiator capable of blowing cool air toward the light source.

An optical module according to the invention implements a fan/radiator assembly which is easy and quick to mount and remove, is compact and low-cost.

The subject of the invention is an optical module comprising a radiator comprising one or more heat dissipation surfaces, a fan capable of conveying air onto said heat dissipation surface(s), and a light source supported by said radiator.

The principal characteristic of an optical module according to the invention is that the radiator is formed from folded metal sheets, the fan being secured to said radiator by securing means provided in said folded metal sheet. In this way, the securing means are thin, exhibit good mechanical behavior and may have a certain aptitude for elastic deformation. All these structural and functional characteristics are particularly suited to the securing of the fan on the radiator. Moreover, a securing configuration of this type dispenses with supplementary components, which are often expensive and bulky, and which are specifically designed for securing the fan on said radiator. This results in an economic saving and a saving of space, which are often sought-after in a motor vehicle. Folded sheets of metal offers the advantage that it can be easily and quickly machined to obtain securing means of variable geometry and size, which are adapted to the characteristics of the fan and of the radiator in question. Each heat dissipation surface may, for example, be represented by a fin or a barb.

Advantageously, the folded sheet metal forms a housing surrounding said heat dissipation surface(s).

Preferably, the folded sheet metal forms a fin, or a plurality of fins, connected together and separated by the folds or curves of said sheet metal, the fin(s) forming the heat dissipation surface(s).

Preferably, the fins and the housing form a single component formed by said folded sheet metal.

Advantageously, the fan is secured to a radiator by clipping. In this way, securing of the fan to the radiator is easy and quick, requiring neither specific tooling or complicated handling necessitating precision and rigor. Furthermore, the fan may be removed from the radiator at any time, as simply and as quickly as it was mounted on said radiator.

Advantageously, the heat dissipation surfaces and the housing form two distinct components.

Advantageously, the securing means are provided in the housing of the radiator.

Preferably, the folded sheet metal forms a fin or a plurality of fins, connected together and separated by the folds or curves of said sheet metal, the fin(s) forming the heat dissipation surface(s), the securing means being provided in the fins of the radiator.

Preferably, the securing means comprise at least two elastically deformable securing tabs.

Advantageously, the housing, the heat dissipation surfaces and the securing means are made from aluminum. Preferably, the aluminum is 99% pure.

Advantageously, the fan comprises complementary securing means capable of interacting with the securing means of the radiator.

Preferably, the light source comprises at least one electroluminescent diode. An electroluminescent diode constitutes a high-performance light source in terms of the intensity of light produced, while at the same time remaining compact.

Preferably, the fan is secured to the radiator by means of a sliding of said fan along said radiator then a locking achieved with the securing means of the radiator. This is a variant embodiment of a light module according to the invention, where the fan is secured laterally onto the radiator.

Advantageously, the sliding is effected by means of an interaction between two grooves and two rails, said two grooves belonging to one of the two elements constituted by the radiator and the fan and said two rails belonging to the other element. In other words, if the two rails belong to the fan, the grooves then belong to the radiator, and vice versa. The grooves are engaged with the rails and slide along the latter until the fan has reached its definitive securing position.

Advantageously, the rails are folded back portions of said folded sheet metal.

A second subject of the invention is a radiator for producing an optical module according to the invention.

A third subject of the invention is a vehicle headlight comprising at least one optical module according to the invention. Indeed, a light module according to the invention is particularly suited to use in a vehicle headlight and, more particularly in a motor vehicle headlight.

An optical module according to the invention offers the advantage of being flexible in use and in maintenance, because the fan can be secured to the radiator simply and quickly and may be removed at any time in just as easy a manner. It has the further advantage of providing a high performance level in terms of temperature regulation, insofar as the radiator is made from folded sheet metal, pure aluminum exhibiting good thermal conduction.

A detailed description is given below of two preferred embodiments of an optical module according to the invention, with reference to FIGS. 1 to 6.

Figure 2:
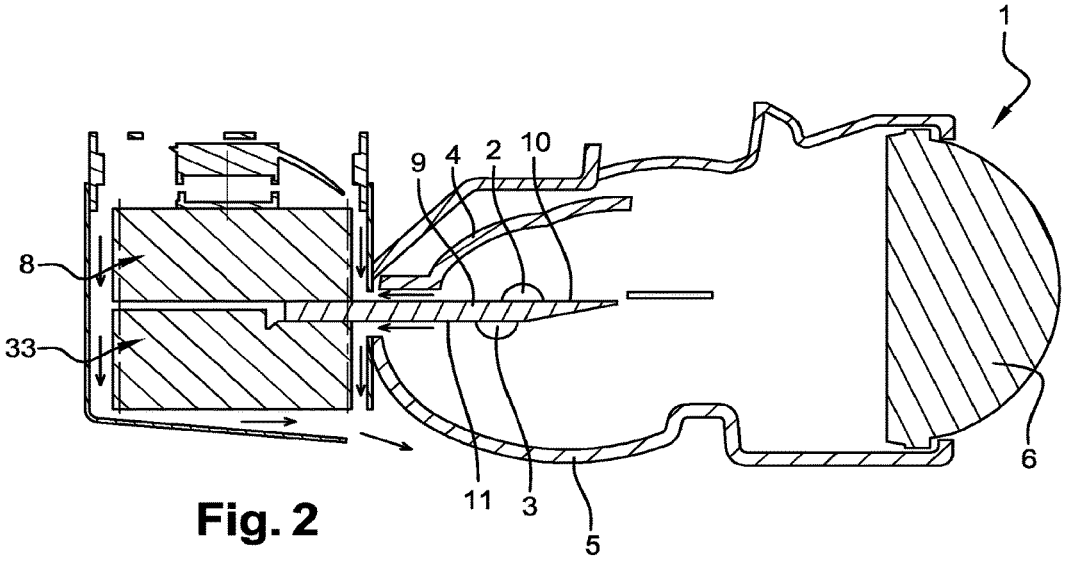
Figure 3:
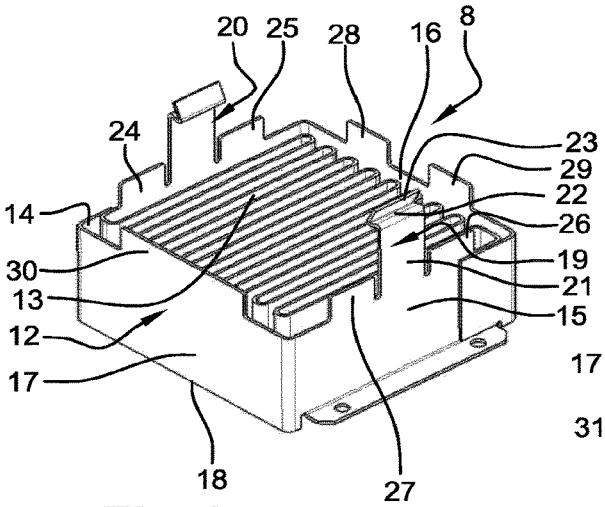
Figure 4:
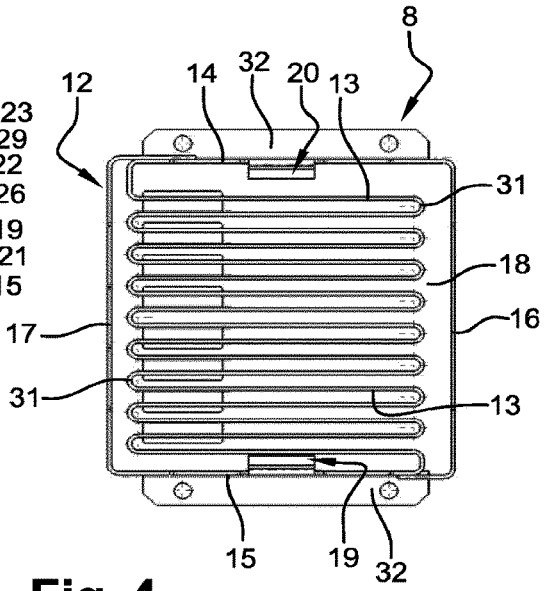
Figure 5:
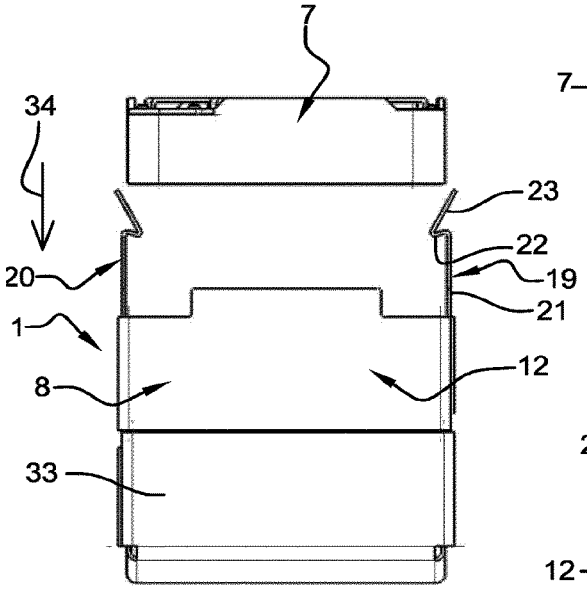
Figure 6:
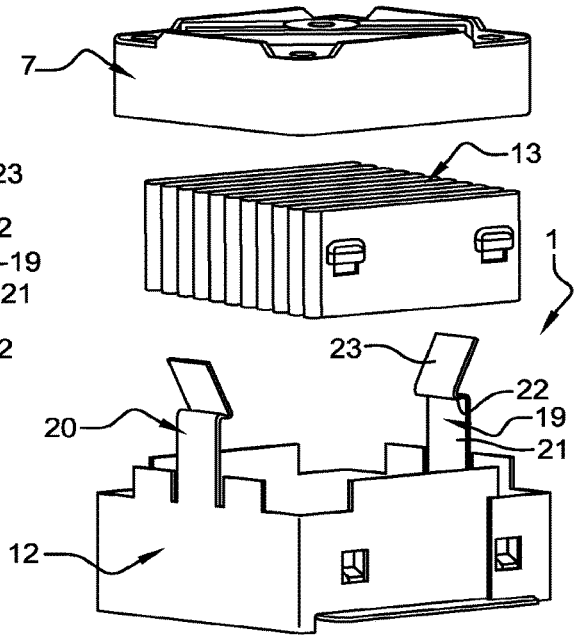

FIG. 1 is a perspective view of an optical module according to the invention, the fan being detached from said module, FIG. 2 is a sectional view of the module of FIG. 1, FIG. 3 is a perspective view of a radiator of an optical module according to the invention, FIG. 4 is a plan view of the radiator of FIG. 3, FIG. 5 is an expanded view of a part of a first preferred embodiment of an optical module according to the invention, FIG. 6 is an expanded view of a part of a second preferred embodiment of an optical module according to the invention.

With reference to FIGS. 1 and 2, an optical module 1 according to the invention constitutes an elongate element and comprises, schematically, two electroluminescent diodes 2, 3, two reflecting surfaces 4, 5, an outlet diopter 6 and a cooling device having a fan 7 and a radiator 8. The two diodes 2, 3 are placed on a planar, thin support component 9 secured to the radiator 8. More precisely, this support component 9 comprises two planar, parallel surfaces 10, 11, a diode 2, 3 being secured to each of said surfaces 10, 11. Each reflecting diopter 4, 5 is curved and located opposite a diode 2, 3 in such a manner as to reflect the light beams issuing from said diode 2, 3 toward the outlet diopter 6. The cooling device is placed behind the diodes 2, 3 relative to the outlet diopter 6. In other words, the diodes 2, 3 are placed between the outlet diopter 6 and the assembly formed by the fan 7 and the radiator 8. The cooling device, the diodes 2, 3 and the outlet diopter 6 are aligned along a longitudinal axis of the optical module 1.

With reference to FIGS. 3 and 4, the radiator 8 comprises a housing 12 and a network of fins 13 made from aluminum. The housing 12 is delimited by four lateral walls 14, 15, 16, 17 and by a bottom 18, two successive walls together forming an angle of 90°. The walls 14, 15, 16, 17 and the bottom 18 are planar, said bottom 18 being perpendicular to each of said walls 14, 15, 16, 17.

With reference to FIGS. 3 and 5, two parallel walls 14, 15 of said housing 12 are each extended by an elastically deformable clipping tab 19, 20, each of said tabs 19, 20 having three segments 21, 22, 23 and two elbows. These two tabs 19, 20 emerge on the same side of the two walls 14, 15 on which they are installed, said side being opposite that where the bottom 18 is located. In this way, each tab 19, 20 extends in a direction that is opposite that where the bottom 18 is located. The first segment 21 extends, in the same plane, the wall 14, 15 from which it emerges, the second segment 22 extends said first segment 21 and tends to extend toward the center of the housing 13. The third segment 23 extends said second segment 22, being slightly inclined relative to the first segment 21 and tends to extend toward the exterior of said housing 12, the two elbows being located between said three segments 21, 22, 23. The third segments 23 of the two tabs 19, 20 opposite one another define between them a space that progressively reduces toward the bottom 18 of the housing 12. Two positioning tabs 24, 25, 26, 27 frame each of the two clipping tabs 19, 20, each of said positioning tabs 24, 25, 26, 27 being constituted by a planar, thin wall extending, in the same plane, the lateral wall 14, 15 of the housing 12 from which it emerges and projecting in the same direction as that of the clipping tab 19, 20. The other two parallel lateral walls 16, 17 of the housing 12 also have positioning tabs 28, 29, 30 having different lengths along said walls 16, 17. The different positioning tabs 24, 25, 26, 27, 28, 29, 30 are designed to delimit a space of the radiator 8 designed to receive the fan 7.

With reference to FIGS. 3 and 4, the fins 13 of the radiator 8 are all the same length and are arranged in said radiator 8, parallel to one another. They are, furthermore, aligned with one another, two successive fins 13 being connected to one another by means of a segment 31 elbowed at 180°. In other words, each fin 13 is extended at its ends by segments 31 elbowed in the opposite direction. The fins 13, machined in the form of sheets may be produced from 99%-pure aluminum, thereby making it possible to ensure high-performance thermal conduction in order, in particular, to cool the optical module 1. The fins 13 of the radiator 8 constitute a monobloc component, housed in the housing 12 of the radiator 8 while remaining totally included in said housing 12 without emerging therefrom. The housing 12 is provided with perforated securing elements 32, parallel to the bottom 18 of said housing 12, to allow screw-type securing thereof, for example, on the planar support component 9 of the optical module 1.

With reference to FIG. 5, according to a first preferred embodiment of an optical module 1 according to the invention, the network of fins 13 and the housing 12 constitute a single piece made from folded aluminum sheet. The fan 7 is brought over the radiator 8, constituted by the housing 12 and fins 13, said radiator 8 being secured to the planar support component 9 of the optical module 1. The fan 7 is then moved in translation from top to bottom as indicated by the arrow 34 in order to be secured on said radiator 8. The fan 7 then passes between the third segments 23 of the two clipping tabs 19, 20, causing a temporary separation of said two tabs 19, 20. The travel of the fan 7 toward the radiator 8 continues until the upper part of said fan 7 has passed the second segments 22 of said tabs 19, 20. The clipping tabs 19, 20 then close on the fan 7, relaxing in order to find their rest position.

With reference to FIG. 6, according to a second preferred embodiment of an optical module 1 according to the invention, the network of fins 13 and the housing 12 constitute two distinct components made from folded aluminum sheet. The component embodying the network of fins 13 is then pre-inserted into the housing 12 to form the radiator 8. The fan 7 is then secured to the radiator 8 in accordance with the same principle as that used for the first preferred embodiment described above.

According to a third preferred embodiment of an optical module 1 according to the invention, the fan 7 may be secured not above the radiator 8 as is the case for the first two preferred embodiments described above but laterally, by means of a sliding on said radiator 8. This lateral sliding is implemented by means of an interaction between two parallel projecting grooves and two parallel rails, said grooves belonging to one of the two elements constituted by the fan 7 and the radiator 8, and said two rails belonging to the other element. The grooves are engaged with the rails and the fan 7 slides laterally on the radiator 8, creating an extra thickness corresponding approximately to the total thickness of said fan. At the end of travel, the fan 7 is locked onto said radiator 8 by clipping.

The invention claimed is:

1. An optical module comprising a radiator comprising one or more heat dissipation surfaces, a fan capable of conveying air onto said heat dissipation surface, and a light source supported by said radiator, wherein the radiator is formed from folded metal sheets, and in that the fan is secured to said radiator by securing means provided in said folded metal sheet.

2. The optical module according to claim 1, wherein folded sheet metal forms a housing surrounding said heat dissipation surface(s).

3. The optical module according to claim 2, wherein the folded sheet metal forms a fin, or a plurality of fins, connected together and separated by the folds or the curves of said metal sheet, the fin forming the heat dissipation surface(s).

4. The optical module according to claim 3, wherein the fins and the housing form a single component formed by said folded metal sheets.

5. The optical module according to claim 1, wherein the fan is secured to the radiator by clipping.

6. The optical module according to claim 2, wherein the heat dissipation surfaces and the housing form two distinct components.

7. The optical module according to claim 2, wherein the securing means are provided in the housing of the radiator.

8. The optical module according to claim 1, wherein the folded sheet metal forms a fin, or a plurality of fins, connected together and separated by the folds or the curves of said metal sheet, the fin(s) forming the heat dissipation surface, and in that the securing means are provided in the fins of the radiator.

9. The optical module according to claim 1, wherein the securing means comprise at least two elastically deformable securing tabs.

10. The optical module according to claim 2, wherein the housing, the heat dissipation surfaces and the securing means are made from aluminum.

11. The optical module according to claim 1, wherein the fan comprises complementary securing means capable of interacting with the securing means of the radiator.

12. The optical module according to claim 1, wherein the light source comprises at least one electroluminescent diode.

13. The optical module according to claim 1, wherein the fan is secured to the radiator by means of a sliding of said fan along said radiator then a locking achieved with the securing means of the radiator.

14. The optical module according to claim 13, wherein the sliding is effected by means of an interaction between two grooves and two rails, said two grooves belonging to one of the two elements constituted by the radiator and the fan and said two rails belonging to the other element.

15. The optical module according to claim 14, wherein the rails are folded back portions of said folded metal sheet.

16. A radiator for producing an optical module according to claim 1.

17. A vehicle headlight comprising at least one optical module according to of claim 1.

18. The optical module according to claim 2, wherein the folded sheet metal forms a fin, or a plurality of fins, connected together and separated by the folds or the curves of said metal sheet, the fin forming the heat dissipation surface(s).

19. The optical module according to claim 2, wherein the fins and the housing form a single component formed by said folded metal sheets.

20. The optical module according to claim 4, wherein the fan is secured to the radiator by clipping.

* * * * *